United States Patent [19]

Poisson

[11] 4,435,919

[45] Mar. 13, 1984

[54] INTEGRATED WINDOW AND THERMAL SHUTTER ASSEMBLY

[76] Inventor: Leandre Poisson, P.O. Box 275, Harrisville, N.H. 03450

[21] Appl. No.: 300,821

[22] Filed: Sep. 10, 1981

[51] Int. Cl.[3] ..... E05B 65/04

[52] U.S. Cl. ..... 49/63; 49/67; 160/236

[58] Field of Search ..... 49/63, 64, 40, 41, 371, 49/74, 84, 90, 67; 160/236, 107

[56] References Cited

U.S. PATENT DOCUMENTS 3,012,294 12/1961 Waldor ..... 49/84 X 3,128,508 4/1964 Burnham ..... 49/40 X

*Primary Examiner*—Kenneth Downey

*Attorney, Agent, or Firm*—Sughrue, Mion, Zinn, Macpeak & Seas

[57] ABSTRACT

One or more side by side cylinders of light transmitting material are mounted for rotation about their axes within a building structure wall opening or the like. The cylinders each bear internally a narrow panel of thermal insulation material such as polystyrene which extends diametrically across the cylinder from one side to the other. The cylinders are mounted for rotation about their axes such that the thermal insulation panels may be aligned and in the plane of the opening to prevent both light and heat transmission from the exterior of the wall of the interior of the building structure. A half cylinder of slightly larger size may surround each cylinder, is fixedly mounted to the building wall to provide at least exteriorly a double glazed wall for increased protection against thermal loss, particularly when the cylinders are rotated such that the insulation panels are at some angle to the plane of the wall opening.

8 Claims, 3 Drawing Figures

22
24
36
40
40a
40b
42
42a
38
50
62
44
49
48
43
46
65
44c

INTEGRATED WINDOW AND THERMAL SHUTTER ASSEMBLY

FIELD OF THE INVENTION

This invention relates to windows, and more particularly, to windows whose light transmission and thermal insulation characteristics may be readily varied.

Window structures in the past have been formed of light transmitting cylinders mounted for rotation about their axes, and wherein on the basis of the make up of the cylindrical assembly the light transmission characteristics may be varied by rotating the cylinders. They also may function to close or open the windows, that is, to permit air to pass therethrough. U.S. Pat. No. 2,888,069 to Johnson teaches a cylindrical assembly involving three sectors including a glass panel in one section, a blast shield in another section, and a wire screen within a third section. By suitably rotating the cylindrical assembly relative to the window opening, the window opening may be closed off by the blast shield (also closing off light transmission to the interior). The glass panel may close off the window opening or by rotation to a third position, a wire screen is interposed within a window opening section which permits the air to pass from the exterior of the building to the interior. None of the elements however to function to provide thermal radiation blockage.

Venetian blinds and the like provide means for preventing light transmission and incidentally tend to block a limited amount of heat tending to radiate outwardly or inwardly through a window covered by such blinds. For instance, U.S. Pat. No. 3,220,065 to Graham shows a plurality of pivotable blades of square form functioning as light shutters and pivoting between 90° in which light is either freely transmitted or blocked. The blades my be formed of suitable plastic, metal or other material and are of opaque material.

However, while such structures have to some degree blocked thermal radiation, such heat blockage aspects are incidental. Further, while rotation of a member about its axis to vary light transmission is a known concept employed in many different ways including those identified above, there has been no effective structural arrangement for facilitating the passage of sunlight interiorly into a building (particularly for passive solar heating), and wherein, during periods in which the sun light is too low to be effective or during the night, by a simple shifting in position of an assembly of given elements, the thermal energy interiorly of the building is prevented from passage exteriorly, thus substantially reducing heat loss of the building structure to which the assembly is applied.

It is therefore, a primary object of the present invention to provide an improved, simple integrated window and thermal shutter assembly which is highly effective, which, even when in light transmitting position, provides a triple thermal insulation effect similar to a triple glazed window, and wherein an array of integrated window and thermal shutters may permit selectively certain of the shutters to close off major thermal radiation interior of the building while permitting substantial light penetration interiorly by reflection.

SUMMARY OF THE INVENTION

The invention is basically directed to an integrated window and thermal shutter assembly for closing a rectangular opening within a building wall or the like to permit controlled passive solar heating of a building interior as well as selectively varying the light transmitted to the building interior. The assembly comprises a closed and elongated cylinder mounted for rotation within the window opening about its axis and within the plane of the window opening. The cylinder is sized to the rectangular opening, and the cylinder is formed of light transmissive material. An opaque, relatively thick rectangular panel of thermal insulation material is mounted internally of the cylinder from end to end and spans diametrically across the cylinder to separate the interior of the cylinder into two dead air spaces.

Rotation of the cylinder to a position with the thermal insulation material panel parallel to the plane of the rectangular opening results in complete blockage of light and thermal energy from the building exterior to the building interior and vice versa, while rotation to an angularly displaced position therefrom permits selectively light and thermal radiation to enter the interior of the building or to pass from the interior to the exterior.

Preferably, a half cylinder of light transmissive sheet material is fixedly mounted across the window opening on the exterior side of the building wall and is spaced slightly from the face of the cylinder. It is sized thereto, and means are provided for sealing the half cylinder about its edges relative to the cylinder to form a thin annular dead air space and a double glazed window with the cylinder.

A metal foil may cover the outer surface of a thermal insulation material panel core of relatively high R factor to reflect light impinging on the surfaces of the panel. The ends of the half cylinder may be affixed to the periphery of sector shaped end pieces of the semi-circular form, and the cylinder is preferably fixed at its ends to circular disc end pieces to close off the elongated cylinder ends. Inclined slots which project inwardly from straight edges of the sector-shaped end pieces receive axles which project from the circular disc end pieces at their centers for the cylinders, to mount the cylinders for rotation about their axis and within the plane of the rectangular opening. A gasket strip fixed to the edges of the half cylinders and the straight edges of the sector-shaped end pieces bear on the periphery of the cylinder and forms with the cylinder and the half cylinder, a double dead air space and triple glazing effect between these members in the open mode. In the closed mode a triple dead air space and a quadruple glazing effect between these members is formed.

DESCRIPTION OF THE PREFERRED EMBODIMENT

Figure 1:
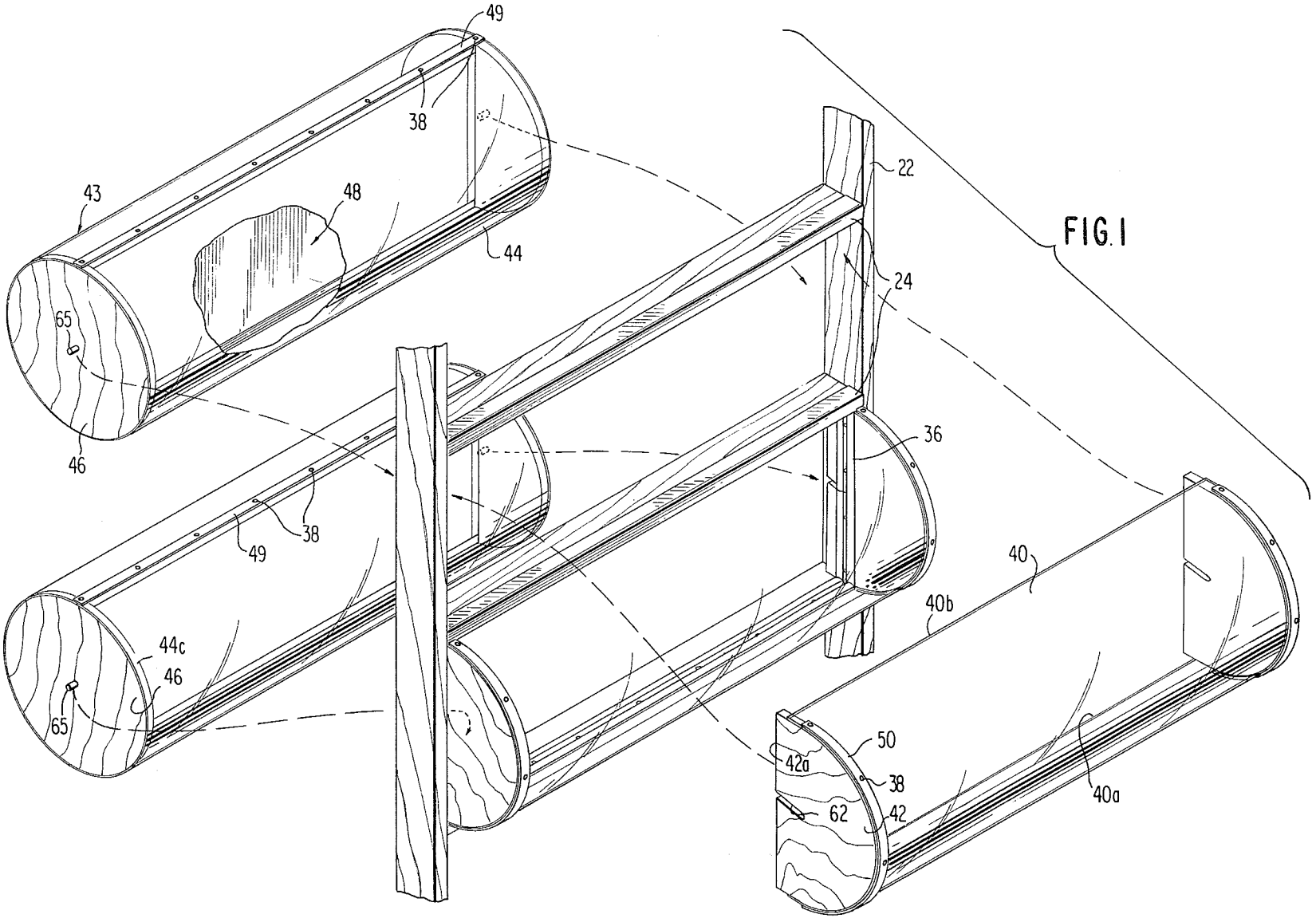
FIG. 1 is an exploded perspective view, partially broken away, of one embodiment of the integrated window and thermal shutter assembly of the present invention.

Referring to the drawings, an integrated window and thermal shutter assembly indicated generally at 10 forms an illustrated embodiment of the invention and extends for some vertical height. It is being mounted to a vertical wall 12 of the building. The building may further be comprised of a concrete floor 14 poured to a vertical edge 16 and upon which mounts the integrated window and thermal shutter assembly 10 filling a large vertical opening defined by the concrete floor 14 and a vertical wall member 18, the window being generally rectangular in shape, formed by vertical studs 22 and horizontal cross bearing or cross studs 24. The lowest horizontal stud 24 forms a sill and may comprise a wooden 2×6 or the like. The studs 22 and 24 may in fact be a part of the main building wall structure per se, which also included exterior wall member 18, and interior wall board 26. The space between the wall board 26 and wall member 18 may be filled with thermal insulation material as at 28 such as fiberglass batting or the like.

Further, a horizontal on edge wooden trim strip 30 completes the wall assembly about the window top.

As indicated, the integrated window and thermal shutter assembly 10 takes the form of three identical, horizontal axis cylindrical integral window and thermal shutter units indicated generally at 32, the units being separated by further horizontal cross studs as at 24 formed of 2×6's or the like and fixedly mounted at their ends to vertical studs 22 under conventional building techniques by being nailed or screwed thereto. The studs 24 function to space the cylindrical units 32 and rigidize their support. In addition, they function to mount semi-cylindrical outside glazing sheets 40 which are formed of a flexible, translucent fiberglass and which may be approximately 0.040 inches in thickness. Initially of rectangular form, they are given a semi-cylindrical curvature by being flexed into semi-cylindrical form. Lower edge **40*a* is screwed or otherwise fixed to the upper face of the underlying stud 24 for each of the assemblies while its opposite edge 40*b*, throughout its length is screwed to the bottom surface of the overlying stud 24. For instance in FIG. 1, the lower stud or floor strip 24 has screwed thereto the lower edge of 40*a* sheet 40, while the upper edge 40*b* of the same sheet is screwed to the bottom surface of the vertically overlying stud 24 with respect to that lowermost unit. While screws are indicated at 38**, other means may be provided, such as nails, staples or the like, to assemble the integrated window and thermal shutter assembly.

Weatherstripping in the form of an elongated resilient rubber tubular strip 36 is mounted to the horizontal studs 24 centered with the edges **40*a* and 40*b* of the sheet 40. The gasket material may take the form of a strip of rubber having enlarged beads 36*a* at its ends and a narrow thin connecting portion as at 36*b* through which screws 38 penetrate, the screws 38 being provided at longitudinally spaced positions but close enough to prevent loss of water and air seal between the exterior surfaces of glazing sheet 40 and the studs 24. Further, in order to maintain the semi-cylindrical sheet 40 sealed at its ends there are provided sector-shaped end pieces 42 which are generally half moon in shape and, of a diameter equal to the interior diameter of the outside glazing sheet 40 when interposed between the horizontal studs 34. The ends 40*c* of the outside glazing sheet 40 are fixed to the periphery of the end pieces 42 as by screws 38, FIG. 2. The outside glazing sheet 40 is fastened to end pieces 42 by way of three-quarter inch pan head as at screws 38 or nails. Aluminum screws are favored but they are not essential. The screws 38 penetrate initially a narrow, thin aluminum pressure strip 50 of a width equal to the thickness of end pieces 42. The outside glazing sheet 40 may be of a length equal to the lateral width of the window within which assembly 10 is fitted. Alternatively as shown in FIG. 1, a series of end to end aligned sheets may be employed. Gasket 36 is not only provided along the lenth of horizontal studs 24 but also upwardly on opposite sides of each unit 32 fixed to the interior surfaces of the sector shaped end pieces 42**.

As may be appreciated, by means of this assembly, the open window within the building structure is sealed by a first outside glazing sheet or window element. Solar radiation is capable of penetration into the interior of the building, emanating from the sun (not shown) as indicated by rays R and impinging upon the concrete floor 14 interiorly of the building as well, FIG. 2.

The second major element of assembly 10 and forming a major component of each of the units 32 are the light transmissive cylinders or shutter/window tubes, indicated generally at 43. These are formed principally of three components; an inside glazing sheet 44, a pair of circular disc end pieces 46, and a metal foil faced thermal insulation panel or thermal shutter indicated generally at 48. The end pieces 46 for cylinder 43 may be made of exterior grade plywood or the like. They may be three-quarters of an inch in thickness. The interior glazing sheet 44 is preferably formed of a fiberglass translucent sheet material. It may be approximately five feet in length, depending upon the width of the window opening or height, (if the cylindrical assemblies are vertically oriented rather than horizontally oriented). In this case, the fiberglass sheet is bent in a circle so that its edges **44*a*, 44*b* abut each other at which point a thin aluminum pressure strip 49 which may be three-quarters of an inch in width and of a length approximately equal to that of the fiberglass glazing sheet 44, may be screwed by screws 38 passing through the edges 44*a*, 44*b* of the sheet 44, or onto one longitudinal edge of panel 48 to maintain the sheet 44 in its cylindrical form and of an appropriate diameter which is slightly less than the diamter of the outside glazing sheet 40 for each unit 32. Additionally, ends 44*c* of the now formed cylindrical inside glazing sheet 44 overlie the periphery of the circular disc 46 end pieces and are affixed thereto by screws 38. The screws 38 function to mount the longitudinal ends of the cylindrical inside glazing sheet 44 to the axially 44*c* spaced end pieces 42** and to thereby form a rather solid cylindrical structure.

Thermal insulation panel 48 is mounted to the interior of the inside glazing sheet cylinder 43, by means of the small screws 38 which penetrate the thickness of the fiberglass glazing sheet 44 and into the wooden strips 56 at opposite lateral sides of the polystyrene core 52 of panel 48. Wooden strips 56 cover all four edges of panel core 56 forming a rectangular frame for the core. It should be noted that the inside glazing sheet cylinder 43 is spaced from the outside glazing sheet 40 by a slight distance to form a dead air space 60 which is also semi-cylindrical. Dead air space 60 provides a high thermal insulation factor to the assembly 10 with the ends of the semi-circular annular space 60 being sealed off by way of gasket 36, interposed between sheets 40 and cylinder 43.

Preferably, the cylinders 43 may be removed from the window frame and moved outside of the semi-cylindrical outside glazing sheet 40 from the interior of the building in a simple lift and remove manner. In that respect, the sector end pieces 42 are provided with inclined mounting slots 62 which incline outwardly and downwardly (as viewed from the interior of the building) that is, they emanate from the straight edge 42*a* of each of the end pieces, the slots 62 at opposite ends of the assembly being aligned with each other.

Axles 65 for rotating the cylinders 43 may be fabricated from one-quarter inch by three and one-half inch ($\frac{1}{4}\times 3\frac{1}{2}''$) lag bolts. Preferably, they are screwed into the exact center of the disclike end pieces 46 for cylinders 43 and into the thermal shutters 48. The hex head lag bolts are inserted into this assembly to the extent where one and one-half inches of the bolt sticks out, the bolt hex heads are then cut off and the pin ends may be smoothed with a file or the like until they easily fit the inclined mounting slots 62. The inclined mounting slots 62 of sector end pieces 42 are capable of maintaining a dead center axle position for cylinders 43 when mounted and may be readily rotated about their axes without any eccentricity. Preferably, a little oil in the bottom of the slots assures the smooth rotation of the individual thermal shutter/window units 32. The shutter/window tubes or cylinders 43 may be simply slid out of their mounting slots for easy maintenance or cleaning, as desired. This also permits access to both faces of the outside glazing sheet 40.

Metal flashing strips may be provided as at 66 and 68 to cover the wooden studs 24, thus covering the outside edged of those studs interposed above and below the shutter/window tubes or cylinders 43.

As indicated in FIG. 1, shutter/window tubes 43 which may be normally five feet in length, may form end to end tube or cylinder arrays of extended length on the order of 20 or 30 feet or more if necessary. The structures are relatively light in weight, although highly efficient thermalwise. When the shutters 48 are rotated to a position parallel to the plane of the window, as for instance the lowermost panel 48 in cylinder 42 in the assembly 10 of FIG. 2 no thermal radiation occurs through the window opening for that tube in either direction. Maximum thermal input to the building interior occurs when a given cylinder 43 is rotated about its axis to a position where the panel or shutter 48 is parallel to the axis of the impinging solar energy as indicated by the position of shutter 48 for the second cylinder 43 from the bottom of the array, FIG. 2.

Figures 2, 3:
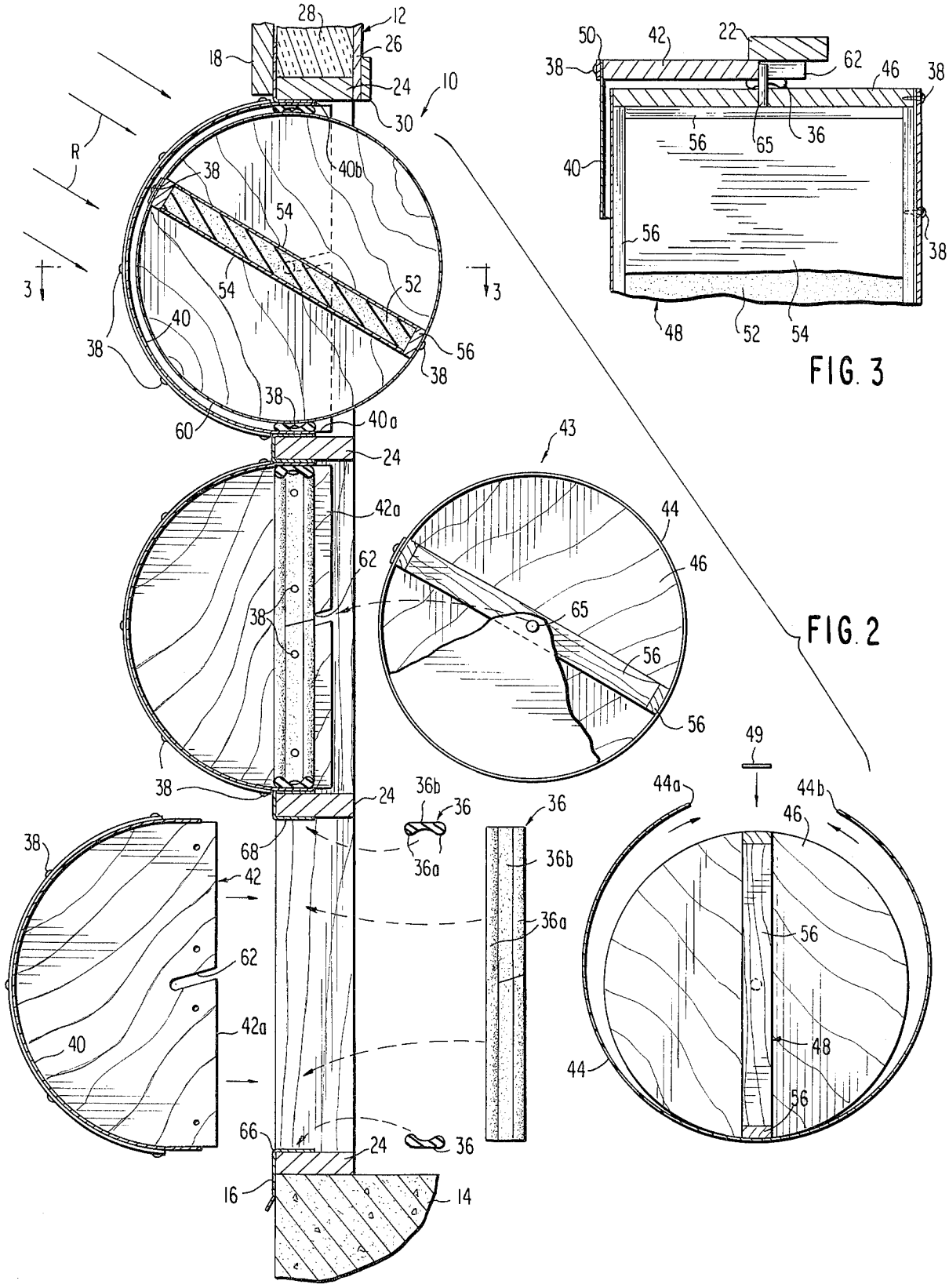
FIG. 2 is a partial exploded, vertical sectional view of the assembly of FIG. 1 with the light transmitting cylinders positioned rearwardly and internally of the window frame to illustrate the method of removably mounting the individual integrated window and thermal shutter cylinder elements.
FIG. 3 is a sectional view of a portion of the assembly of FIG. 2, taken about line 3—3.

As may be further appreciated, by utilizing a reflective metal foil as an outside layer 54 or coating on a thermal insulation core 52, the light rays R are appropriately reflected by the simple expedient of rotating a given cylinder 43 about its axis A, FIG. 2, so that light impinges on the light reflecting foil.

Preferably, the studs as at 22, 24 should be finished with a high gloss white paint which readily reflects light. This insures maximum light and thermal energy penetration into the interior of the building.

Since the rotatable cylinders 42 may be easily mounted between vertical or horizontal studs, the system may be easily retrofitted to existing structures in either the vertical or horizontal mode. With multiple cylinders forming a vertical or horizontal array, the cylinders may be individually rotated if they are not interconnected. This may be achieved manually. Alternatively, all cylinders may be tied mechanically by way of a rack and pinion mechanism or the like such that by rotation of any one of the cylinders, all will rotate in unison. Further, servomotors may be employed and controlled by light or heat sensors for rotating any or all of the cylinders or shutter/window tubes, again, either in unison or individually. The shutters or panels 48 may be similarly colored, they may be color of the metal foil or they may be dissimilarly colored to provided different color effects as a result of rotation to given positions. Opposite surfaces of the panels could bear different colors to provide contrasting changeable effects.

Polystyrene, styrofoam or like material may form the thermal insulation for the core of the shutters 48 and is preferably reinforced about all four edges by rigid wooden strips particularly to facilitate mounting of the panel interiorly of the cylinder or tube and to effect rotation of the shutter/window tube about its axis.

In addition to the outside glazing sheet 40 acting in conjunction with the inside glazing sheet 44 (in cylindrical form) to form, at all times, a double glaze outside wall to one side of panel 48 a single glaze light transmitting interior wall is formed on the opposite side of that panel. The dead air space between the opposed faces of panel 48 and the inside glazing sheet 44 amplifies the thermal insulation effect, while permitting, selectively ready transmission of the sun's radiant energy interiorly of the building. The gaskets 36 act as a peripheral seal for each unit 32 regardless of the angle of inclination of the cylinder borne insulation material panel 48, the cylinder 43 riding in air sealing surface contact with the face of the gasket member which press against the outside of the cylinder 43.

Also, while the outside glazing sheet 40 and the inside glazing sheet 44 have been described as being formed of translucent material, they could be made transparent, although light passing through the cylinder would tend to distort and obviously the view would not be the same as a clear glass vertical pane, even triple glazed parallel panes.

While the invention has been particularly shown and described with reference to a preferred embodiment thereof, it will be understood by those skilled in the art that various changes in form and details may be made therein without departing from the spirit and scope of the invention.

What is claimed is:

1. An integrated window and thermal shutter assembly for closing a rectangular opening within a building wall or the like to permit controlled passive solar heating of a building interior, said assembly comprising:

a closed end elongated cylinder mounted for rotation about its axis within said window opening and in the plane of said rectangular opening, said cylinder being sized to said rectangular opening and said cylinder being formed of a sheet of light transmissive material, and an opaque, relatively thick rectangular panel of thermal insulation material mounted internally of said cylinder and spanning diametrically across said cylinder to separate the interior of said cylinder into two dead air spaces;

whereby, rotation of said cylinder to a position with the thermal insulation material panel parallel to the plane of said rectangular opening results in complete blockage of light and thermal energy from the building exterior to the building interior and vice versa while, rotation to an angularly displaced position therefrom permits selectively light and thermal radiation to enter the interior of the building, or leave the same.

2. The integrated window and thermal shutter assembly as claimed in claim 1, further comprising a half cylinder of light transmissive sheet material fixedly mounted across said window opening on the exterior of and being spaced slightly from the face of said cylinder and being sized thereto, and means for wipe sealing said half cylinder about its edges relative to said cylinder to form a thin annular dead air space and a double glased window with said cylinder.

3. The integrated window and thermal shutter assembly as claimed in claim 1, wherein said panel comprises a thermal insulation material core of relatively high "R" factor, with a light reflective metal foil covering the outer surface of said core.

4. The integrated window and thermal shutter assembly as claimed in claim 2, wherein said panel comprises a thermal insulation core of relatively high "R" factor, with a light reflective metal foil covering the outer surface of said core.

5. The integrated window and thermal shutter assembly as claimed in claim 2, wherein said means for sealing the ends of said half cylinder comprise sector shaped end pieces of semi-circular form fixed at their peripheries to respective ends of said half cylinder, and wherein said cylinder comprises circular disc end pieces sealably fixed at their peripheries to respective axial ends of said cylinder to close off said elongated cylinder ends, and wherein said sector shaped end pieces include inclined slots projecting inwardly from straight edges thereof and wherein axles project axially outwardly from the centers of said circular disc end pieces of said cylinder and are received within said slots and form said means for mounting said cylinders for rotation about their axis and within the plane of said rectangular opening.

6. The integrated window and thermal shutter assembly as claimed in claim 5, wherein said means for wipe sealing said half cylinder concentric to said such cylinder comprises a gasket fixed to all four edges of the half cylinder and bearing on the periphery of the coaxial cylinder such that said cylinder rotates on said gaskets with rubbing surface contact to form an annular sealed space between said half cylinders and the outer periphery of said cylinders during rotation of said cylinder about its axis.

7. An integrated window and thermal shutter assembly for closing off a rectangular opening within a building wall or the like, said wall comprising intersecting, opposed vertical and horizontal studs mounted within said rectangular wall opening, a plurality of cross studs extending across said opening at laterally spaced positions to form rectangular segments within said opening bounded by said studs, a plurality of half cylinders of light transmissive material having diametrically opposed longitudinal edges fixedly and sealably mounted to said studs defining said window opening segments, sector shaped end pieces, said half cylinders being sealably mounted at respective ends, to the circumferential edge of said sector shaped end pieces, compressible material gasket strip extending along said and overlying opposed longitudinal edges of said half cylinder and aligned edge of said sector shaped end pieces, closed end elongated cylinders formed of light transmissive material mounted for rotation about their axes within said window opening segments and coaxially within half cylinders, said cylinders being of a diameter slightly smaller than the diameter of said half cylinders and forming with said half cylinders a double glazed light transmissive outer wall and a single glazed light transmissive inner wall, relatively thick opaque thermal insulation panels of rectangular form mounted interiorly of said cylinder and extending diametrically from one side of said cylinder to the other and being fixed thereto to rotate therewith;

whereby, rotation of said cylinders such that said thermal insulation panels are positioned in line with the plane of the window opening within each segment, prevents light impingement and thermal radiation from the outside of the building to the interior thereof, while rotation of respective cylinders to angularly displaced positions therefrom selectively permits thermal and light radiation internally of said building wall through said light transmissive half cylinders and cylinders.

8. The integrated window and thermal shutter assembly as claimed in claim 7, wherein said thermal insulation panels comprise a rectangular core of a relatively high R thermal insulation material, wooden strips fixed to the edges of said core, means for rigidly connecting opposed longitudinal edges of said panels to diametrically opposite sides of said cylinders and wherein reflective metal foil covers the major faces of said insulation material core on opposite sides thereof to enhance thermal and light radiation through said cylinder by reflecting said radiation from the sides of said thermal insulation panels, when said cylinder is in a position other than one in which the panel is coplanar with the plane of the window opening.

* * * * *